US008889328B2

(12) United States Patent
Matsumoto

(10) Patent No.: US 8,889,328 B2
(45) Date of Patent: Nov. 18, 2014

(54) METHOD FOR SELECTING DEVELOPER, DEVELOPER, AND IMAGE FORMATION DEVICE

(71) Applicant: Oki Data Corporation, Tokyo (JP)

(72) Inventor: Hayato Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1 day.

(21) Appl. No.: 13/657,995

(22) Filed: Oct. 23, 2012

(65) Prior Publication Data

US 2013/0287419 A1 Oct. 31, 2013

(30) Foreign Application Priority Data

Oct. 28, 2011 (JP) ..... 2011-236628

(51) Int. Cl.

| | |
|---|---|
| ***G03G 9/08*** | (2006.01) |
| ***G03G 9/107*** | (2006.01) |
| ***G03G 9/097*** | (2006.01) |
| ***G03G 15/08*** | (2006.01) |
| ***G03G 9/087*** | (2006.01) |

(52) U.S. Cl.

CPC ..... *G03G 9/0825* (2013.01); *G03G 9/1075* (2013.01); *G03G 9/0975* (2013.01); *G03G 9/09725* (2013.01); *G03G 9/09741* (2013.01); *G03G 9/09791* (2013.01); *G03G 9/107* (2013.01); *G03G 15/0824* (2013.01); *G03G 9/08782* (2013.01); *G03G 9/09716* (2013.01); *G03G 9/0821* (2013.01); *G03G 9/08755* (2013.01)

USPC ..... 430/108.22; 430/108.3; 430/109.4

(58) Field of Classification Search

CPC ..... G03G 9/09741; G03G 9/09783; G03G 9/0791; G03G 9/09775; G03G 9/08755

USPC ..... 430/108.22, 108.3, 109.4

See application file for complete search history.

(56) References Cited

U.S. PATENT DOCUMENTS

| | | | | | |
|---|---|---|---|---|---|
| 4,407,924 | A * | 10/1983 | Senshu et al. | ..... | 430/108.3 |
| 4,812,377 | A * | 3/1989 | Wilson et al. | ..... | 430/109.5 |
| 5,102,762 | A * | 4/1992 | Tyagi et al. | ..... | 430/109.4 |
| 5,225,300 | A * | 7/1993 | Tsubota et al. | ..... | 430/108.3 |
| 5,502,118 | A * | 3/1996 | Macholdt et al. | ..... | 525/437 |
| 5,962,177 | A * | 10/1999 | Sacripante et al. | ..... | 430/109.4 |
| 6,365,318 | B1 * | 4/2002 | Moffat et al. | ..... | 430/137.15 |
| 7,309,558 | B1 * | 12/2007 | Michel et al. | ..... | 430/137.1 |
| 8,053,532 | B2 * | 11/2011 | Farrugia | ..... | 525/355 |
| 2006/0093938 | A1 * | 5/2006 | Stulc et al. | ..... | 430/108.3 |

FOREIGN PATENT DOCUMENTS

| | | | | | |
|---|---|---|---|---|---|
| JP | 02022670 | A * | 1/1990 | ..... | G03G 9/097 |
| JP | 06161155 | A * | 6/1994 | ..... | G03G 9/097 |
| JP | 10221879 | A * | 8/1998 | ..... | G03G 9/08 |
| JP | 2005352081 | A * | 12/2005 | ..... | G03G 9/097 |
| JP | 2010-164707 | A | 7/2010 | | |

OTHER PUBLICATIONS

Diamond, Arthur S & David Weiss (eds.) Handbook of Imaging Materials, 2nd ed.. New York: Marcel-Dekker, Inc. (Nov. 2001) pp. 173-191.*

English language machine translation of JP 06-161155 (Jun. 1994).*

English language machine translation of JP 2005-352081 (Dec. 2005).*

English language machine translation of JP 10-221879 (Aug. 1998).*

Kamei, Yuya et al. "A Highly Stable Charge-Control Agent Based on an Al-Complex with Salicylic Acid Derivatives Used for Full Color Toners" Journal of Imaging Science and Technology 53(2) (2009).*

Anderson, J.H. "The effect of additives on the tribocharging of electrophotographic toners" Journal of Electrostatics 37 (1996) pp. 197-209.*

English language translation of JP 02-022670 (Jan. 1990).*

* cited by examiner

*Primary Examiner* — Christopher Rodee

(74) *Attorney, Agent, or Firm* — Marvin A. Motsenbocker; Mots Law, PLLC

(57) ABSTRACT

A developer to develop an electrostatic latent image satisfying the requirements of 0.85≤Q60/Q600 and 10≤Q600≤20, where Q60 (−μC/g) represents a charge amount of the developer when a sample, made by adding the developer to a carrier such that the concentration of the developer is 5%, is shaken for 60 seconds, and Q600 (−μC/g) represents a charge amount of the developer when shaken for 600 seconds under the same conditions.

7 Claims, 13 Drawing Sheets

SUMMARY OF EVALUATION RESULTS OF SHEET FOG AND BLOTS

EVALUATION RESULT OF BLOTS OF DEVELOPER BASE MATERIAL B-3 SERIES

METHOD FOR SELECTING DEVELOPER, DEVELOPER, AND IMAGE FORMATION DEVICE

CROSS REFERENCE TO RELATED APPLICATIONS

This application claims priority based on 35 USC 119 from prior Japanese Patent Application No. 2011-236628 filed on Oct. 28, 2011, entitled "METHOD FOR DETERMINING DEVELOPER PROPERTY, DEVELOPER, AND IMAGE FORMATION DEVICE", the entire contents of which are incorporated herein by reference.

BACKGROUND OF THE INVENTION

1. Field of the Invention

The invention relates to a method for selecting a developer, a developer, and an image formation device.

A general image formation device using electrophotography includes: an exposure unit; an image carrier (photosensitive roller) on which an electrostatic latent image is formed by exposure; a development device configured to visualize the electrostatic latent image by adhering a developer containing at least a colorant to the electrostatic latent image; a transfer unit configured to transfer the obtained visible image to a transfer material such as a transfer paper; and a fixation unit configured to fix the visible image with heating and pressure. In addition, the development device includes a developer carrier and a developer supply unit configured to supply the developer to the developer carrier.

Patent Document 1 (Japanese Patent Application Laid-Open No. 2010-164707 (Claim 2)) discloses the technique to obtain good printing with few blots by setting the charge amount of a developer, and the peripheral speed ratio of a developer supply unit (sponge roller) to a developer carrier (development roller) in a predetermined range. This technique assumes that the peripheral speed of the developer supply unit is 100 mm/sec to 150 mm/sec.

SUMMARY OF THE INVENTION

However, in a conventional image formation device, even though the peripheral speed ratio of a developer carrier (development roller) to a developer supply unit is set, high peripheral speed (development speed) of each of the developer carrier and the developer supply unit results in more frequent triboelectric charging of a developer and may cause a problem of generating a defect of blots. Low peripheral speed thereof results in less frequent triboelectric charging of the developer and may cause a problem of generating a defect of sheet fog. Further, poor charging properties of the developer leads to insufficient charging of the developer supplied to the portion consumed by printing and may cause a problem of generating afterimage on the surface of the development roller.

An object of an embodiment of the invention is to suppress blots, sheet fog, and afterimage to improve a printing image.

An aspect of the invention is a developer to develop an electrostatic latent image satisfying the requirements of $0.85 \leq Q60/Q600$ and $10 \leq Q600 \leq 20$, where Q60 (−μC/g) represents a charge amount of the developer when a sample is made by adding the developer to a carrier such that the concentration of the developer is 5% and is shaken for 60 seconds, and Q600 (−μC/g) represents a charge amount of the developer when shaken for 600 seconds under the same conditions.

A small saturation charge amount of the developer (for example, when Q600 is less than 10 (−μC/g)) increases the rate of the developer charged in reverse polarity due to the shortage of the charge amount, so that a defect of sheet fog tends to be generated. On the other hand, a large saturation charge amount of the developer (such as when Q600 is more than 20 (−μC/g)) increases the thickness of a developer layer on a development roller due to electrostatic aggregation caused by the excessive charging, so that blots tend to be generated.

In addition, high charging properties of the developer (for example, when Q60/Q600 is 0.85 or more) causes the fresh developer supplied to the portion consumed by printing to be sufficiently charged in a short period of time on the surface of the development roller and thus reduces the difference of the potential thereof with the developer in the portion which is not consumed by printing. Accordingly, any afterimage is hardly generated.

According to the above aspect, a good printing image in which blots, sheet fog, and afterimage are suppressed is obtained.

DETAILED DESCRIPTION OF EMBODIMENTS

Figure 1:
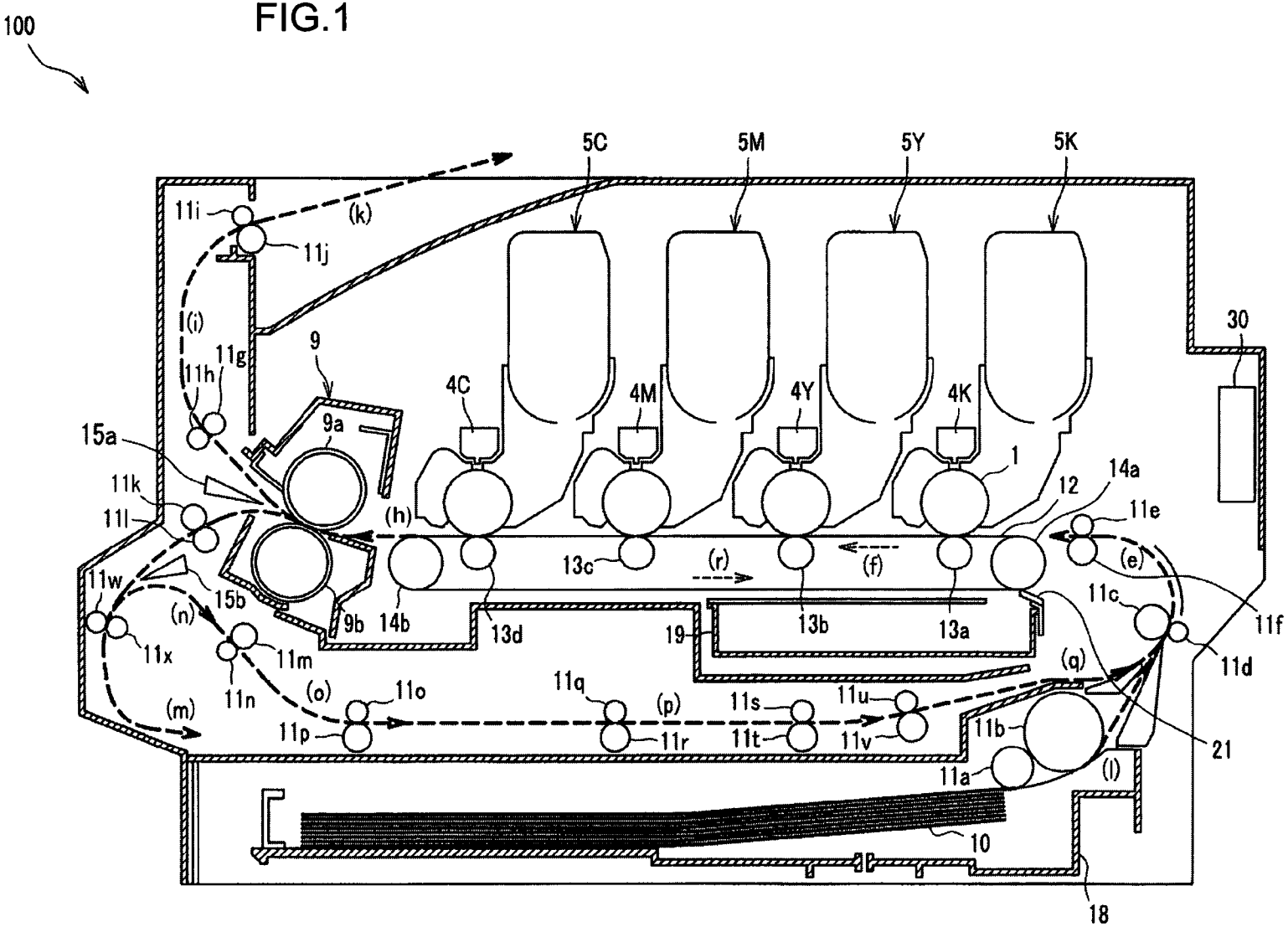
FIG. 1 is an entire configuration diagram of an image formation device according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments of the invention are described below with reference to the accompanying drawings. In each drawing, common elements and similar elements are donated by the same reference numerals and these overlapping descriptions are omitted.

First Embodiment

Description of Configuration

FIG. 1 is an entire configuration diagram of an image formation device according to a first embodiment of the invention.

In FIG. 1, image formation device 100 is configured as a tandem color printer capable of electrophotographic printing on both sides of medium (recording paper) 10, including: four development devices 5 (5K, 5Y, 5M, 5C); LED heads 4 (4K, 4Y, 4M, 4C) as four exposure devices; fixation unit 9; transfer rollers 13 (13*a*, 13*b*, 13*c*, 13*d*) as four transfer units; conveyance rollers 11 (11*a*, 11*b*, . . . , 11*x*); transfer belt 12; drive roller 14*b*; belt idle roller 14*a* as a driven roller; recording paper run guides 15*a* and 15*b*; paper cassette 18, waste developer tank 19, and cleaning blade 21 as a recovery unit. The letters K, Y, M, and C expressing colors correspond to black, yellow, magenta, and cyan. The invention is applicable not only to a printer but also to a copy machine, FAX, and MFP (Multi Function Printer).

As for development devices 5, four color development devices 5K, 5Y, 5M, and 5C each filled with developer (toner) are arranged along conveyance direction (f). Each development device 5 develops an electrostatic latent image formed by exposure to form a developer image. Development device 5 is described below with reference to FIG. 2. LED heads 4 are single crystal film light emitting elements arranged linearly, and selective light emission of the LEDs according to print data exposes the surface of photosensitive drum 1 to form the electrostatic latent image Transfer rollers 13*a*, 13*b*, 13*c*, and 13*d* transfer the developer image formed in development device 5 to medium 10. Fixation unit 9 fixes the developer image transferred to medium 10 by heating to a predetermined fixation temperature and pressurizing. Fixation unit 9 includes heat member (heat roller) 9*a* and pressure member (pressure roller) 9*b*, and is covered with a fixation case so that internal heat may not be released outside.

Paper cassette 18 is disposed in the lower part of the device body, and accommodates one or more media 10. Conveyance rollers 11 (11*a*, 11*b*, . . . , 11*j*) convey medium 10 from paper cassette 18 to a paper stacker and, particularly, conveyance rollers 11*a* and 11*b* may be called feed rollers. Transfer belt 12 is a belt member formed in an endless form, and conveys medium 10 to fixation unit 9. Transfer belt 12 as a conveyance member and a first transfer member is associated with a motor as a drive part. Belt idle roller 14*a* gives tension so that transfer belt 12 may not be slackened.

Drive roller 14*b* and belt idle roller 14*a* are conveyance units configured to rotate transfer belt 12 and also function as cool units configured to cool transfer belt 12 warmed by fixation unit 9. Recording paper run guides 15*a* and 15*b* move with rotating so that the run direction of medium 10 is changed. Cleaning blade 21 is provided under (or at the side of) belt idle roller 14*a*, and waste developer tank 19 is provided under belt idle roller 14*a* and transfer belt 12.

Alphabetical lowercase letters with parentheses, which are accompanied by bold dashed lines/fine arrows, described in FIG. 1 indicate a conveyance path of medium 10 including at the time of double-sided printing. Accordingly, medium 10 passes through conveyance path 1 from paper cassette 18 and conveyance rollers 11*a* and 11*b* to reach conveyance rollers 11*c* and 11*d*, and further passes through conveyance path (e) to reach conveyance rollers 11*e* and 11*f*. Then, while medium 10 is conveyed on the upper surface of transfer belt 12, development device 5 and transfer roller 13 transfer the developer image on the surface of medium 10, and pass through fixation unit 9.

In the case of double-sided printing, medium 10 is directed to conveyance rollers 11*k* and 11*l* by recording paper run guide 15*a*, and passes through conveyance rollers 11*w* and 11*x* (conveyance path (m)) due to the action of recording paper run guide 15*b*. Then, conveyance rollers 11*w* and 11*x* by which the back end of medium 10 is sandwiched are inverted, and a direction change caused by recording paper run guide 15*b* allows medium 10 to pass through conveyance path (n) to reach conveyance rollers 11*m* and 11*n*. Then, medium 10 passes through conveyance paths (o), (p), and (q) to reach conveyance rollers 11*c* and 11*d* again. At this time, the front and back sides of medium 10 are inverted, and medium 10 passes through conveyance path (e) and conveyance rollers 11*e* and 11*f* to reach transfer belt 12.

Then, development device 5 and transfer roller 13 transfer the developer image on the back side of medium 10, and fixation unit 9 fixes the developer image transferred on medium 10.

Then, rotational movement of recording paper run guide 15*a* causes medium 10 to be directed to conveyance rollers 11*g* and 11*h*. Then, medium 10 passes through conveyance path (i) to reach conveyance rollers 11*i* and 11*j*, and passes through conveyance path (k) to be ejected to the paper stacker.

Figure 2:
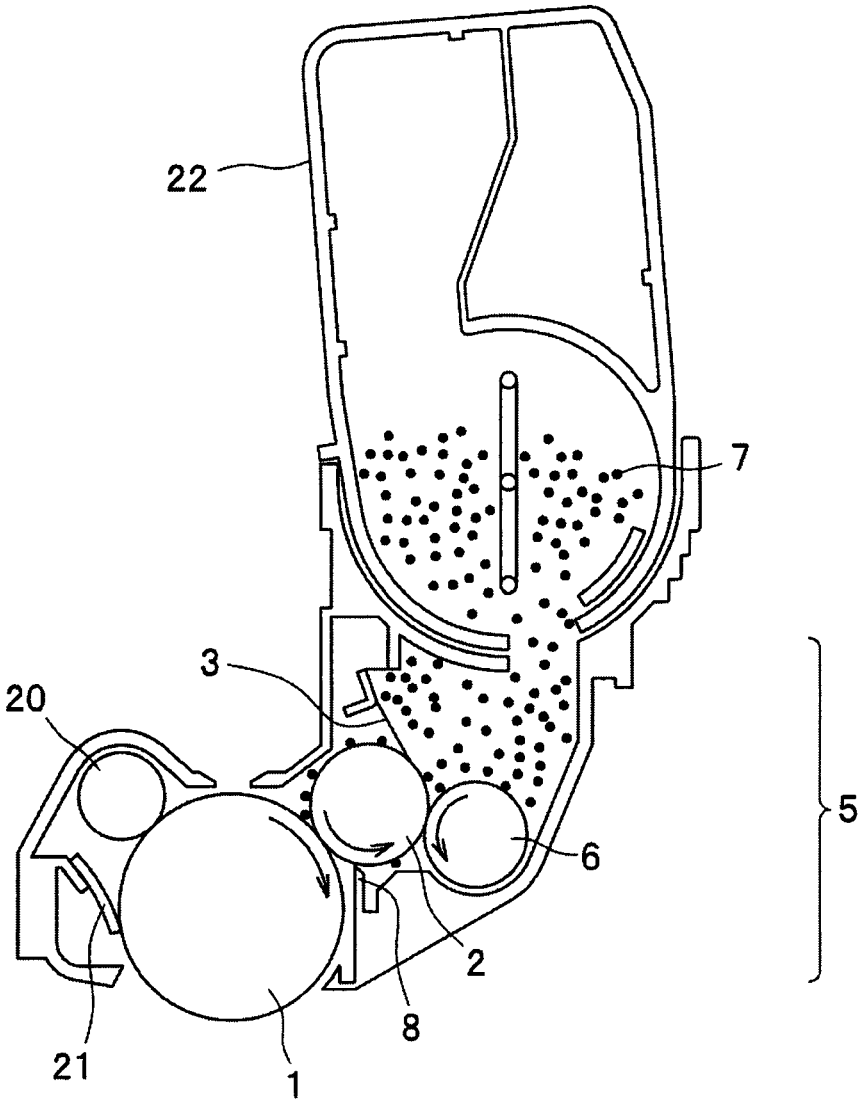
FIG. 2 is a configuration diagram of a development device and a developer cartridge according to the first embodiment of the invention.

FIG. 2 is a configuration diagram of the development device and a developer cartridge according to the embodiment.

Development device 5 includes: photosensitive drum 1 as an image carrier rotatable at a predetermined speed, on which the electrostatic latent image and a visible image are formed; charge roller 20 as a rotatable charge member accompanied by photosensitive drum 1 and configured to charge the surface of photosensitive drum 1 uniformly; development roller 2 as a developer carrier configured to develop the electrostatic latent image formed in photosensitive drum 1 by adhering the developer to the electrostatic latent image; development blade 3 as a control member welded to development roller 2 by pressure and configured to control the layer thickness of the developer and charge the developer in a predetermined polarity; developer supply roller 6 as a supply member in contact with development roller 2, the peripheral surface at the contact part moving to an opposite direction to development roller 2, and configured to supply developer 7 in development device 5 to the development roller 2 side; sealant 8 configured to prevent developer 7 from leaking to the outside of development device 5; and cleaning blade 21 made of urethane rubber as a recovery device and configured to recover the developer remaining on the surface of photosensitive drum 1 after transfer. At the upper part of development device 5, a supply opening configured to supply developer 7 into the development device is provided, and developer cartridge 22 configured to accommodate developer 7 inside is removably installed. Since development roller 2 and developer supply roller 6 rotate in opposite directions to each other, developer 7 remaining on development roller 2 without being transferred is scraped off.

Photosensitive drum 1 has a photosensitive layer (photoconductive insulation layer) formed of an organic compound in an aluminum element tube, and the outer diameter (ϕ) thereof is 29.95 mm. The photosensitive layer of photosensitive drum 1 has characteristics as an insulator when not exposed to light, and becomes conductive to have characteristics of releasing charge when exposed to light.

For example, photosensitive drum 1 charged to the surface potential of −600 V (or −550 V) is discharged to the latent image potential of −40 V when exposed. As for photosensitive drum 1, the electrostatic latent image is developed by development roller 2 to form the developer image. For example, −200 V is applied to development roller 2, and the surface potential of the developer layer thereof is −50 V to −80 V. Negatively charged developer 7 of −40 V moves and adheres to the electrostatic latent image and visualizes the electrostatic latent image. Charged roller 20 includes a metal shaft and semi-conductive epichlorohydrin rubber, and is charged at −1100 V. Further, −300 V (or −250 V) is applied to developer supply roller 6.

Figure 3A:
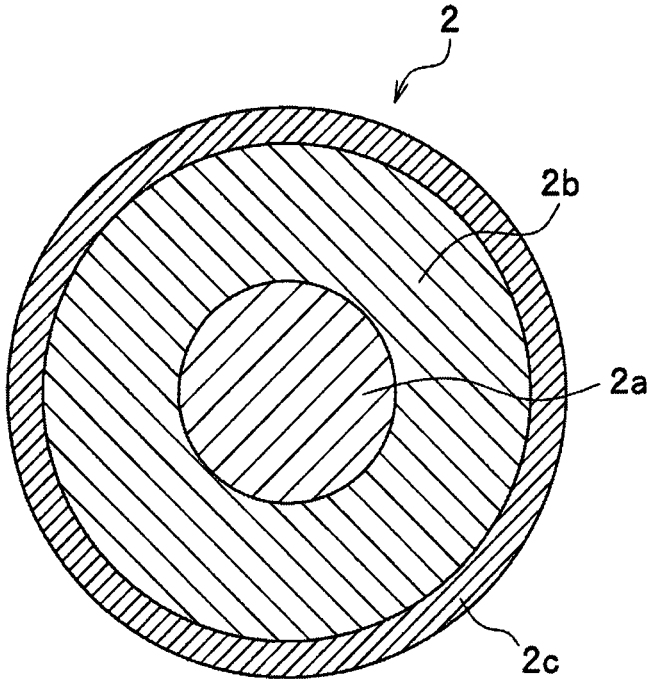
FIGS. 3A and 3B are detailed diagrams of a development roller and a developer supply roller used in the development device, respectively.
Figure 3B:
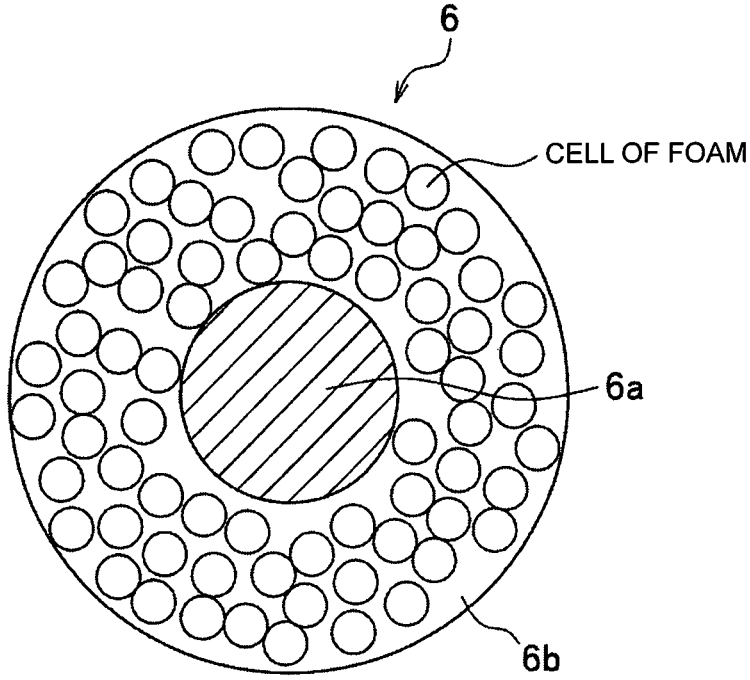

FIGS. 3A and 3B are detailed diagrams of the development roller and the developer supply roller used in the development device, respectively.

Development roller 2 includes: cored bar 2*a* made of steel and having the surface plated with nickel; elastic layer 2*b* formed of urethane rubber in the circumference of cored bar 2*a*; and surface layer 2*c* of isocyanate formed on the surface of elastic layer 2*b*. The outer diameter (ϕ) of development roller 2 is 19.6 mm. Developer supply roller 6 is a sponge roller including silicone foamed rubber (elastic layer 6*b*) in the circumference of cored bar 6*a*, and presents a crown shape with the outer diameter (ϕ) of 15.5 mm at the center and 14.8 mm at the end. Elastic layer 2*b* of development roller 2 is more firmly configured than elastic layer 6*b* of developer supply roller 6.

Developer supply roller 6 includes elastic layer 6*b* of silicone foamed rubber formed around cored bar 6*a*. Elastic layer 6*b* of silicone foamed rubber is made of open-cell foam having a diameter of each cell of 300 to 500 μm. The diameter of each cell of elastic layer 6*b* in developer supply roller 6 is measured through a CCD camera. Specifically, 10 cells having almost the same size are selected visually, and the average value of the opening diameter of 10 selected cells is calculated. With respect to the opening diameter of the cell, the major axis and minor axis of an ellipse formed by the periphery of the cell are measured to obtain the area of the ellipse from the measured result, and the diameter of the perfect circle having the same area corresponds to the opening diameter of the cell.

Regarding development blade 3, a stainless plate (SUS304B-TA) having a thickness of 0.08 mm is bent at R=0.275 mm and welded by pressure to development roller 2 such that the shorter side thereof thus bent is in an upstream side and the longer side thereof is in a downstream side, as viewed from the rotation direction of development roller 2 welded by pressure, and the stainless plate is bent with the same linear load (about 90 to 70 gf/cm). Interaction of development blade 3 with development roller 2 controls the layer thickness of developer 7 and causes the developer to be triboelectrically negatively charged.

Developer 7 is a non-magnetic single-component pulverized developer which is negatively charged. Developer 7 includes a developer base material (developer base particles or developer mother particles) made of a resin and a release agent (wax), and an external additive (external additive particles), such as silica or a metal oxide, is added to and around the developer base particles. The external additive particles are added to prevent the base particle of developer 7 from directly contacting with another member (such as another base particle, development roller 2, or etc) by functioning like a roller bearing when developer 7 comes into contact with the other member. The external additive particles are bound to the developer base particles by a Van der Waals force etc.

Developer 7 used in the embodiment is manufactured by the following pulverization method, but the materials and procedures are not limited to the followings.

As the materials of developer 7, the followings are used: 100 parts by weight of an amorphous polyester resin as a binder resin; 0.10 parts by weight of a metal complex of salicylic acid as a negatively charged charge control agent (hereinafter, referred to as CCA); 3.00 parts by weight of a polyester resin having a quaternary ammonium salt as a positively charged charge control resin (hereinafter, referred to as CCR); 4.0 parts by weight of MOGUL-L (Cabot Corporation) as a colorant; and 3.0 parts by weight of carnauba wax as a release agent, with respect to 100 parts by weight of the amorphous polyester resin.

The base particles of developer 7 (developer base particles A-1) can be obtained as follows. The above-described materials are mixed using a Henschel mixer (produced by Mitsui Mining Co., Ltd.), and then kneaded by a twin screw extruder while heating at a temperature of 100° C. The obtained mixture is milled by a cutter mill having a screen diameter of 2 mm after cooling, subsequently ground using a collision plate type grinder Dispersion Separator (produced by Nippon Pneumatic Mfg. Co., Ltd.), and further classified using an air classifier to obtain the base particles of developer 7.

Then, the developer base particles (bodies) are obtained by using the same materials and procedures as described above and varying the amount of CCA and CCR added so as to have predetermined charging characteristics in manufacturing. They are referred to as developer base particles A-2 to A-5, B-1 to B-5, C-1 to C-5, D-1 to D-5, and E-1 to E-5, respectively. Further, 100 parts by weight of the amorphous polyester resin, 4.0 parts by weight of MOGUL-L (Cabot Corporation), and 3.0 parts by weight of carnauba wax represent the central values of the amounts, and the developer base particles are also obtained by using the amount of ±10% parts by weight of each.

In addition, developer base particles A-1 to A-5 are obtained with 3.00 wt % CCR, developer base particles B-1 to B-5 are obtained with 2.25 wt % CCR, developer base particles C-1 to C-5 are obtained with 1.5 wt % CCR, and developer base particles D-1 to D-5 are obtained with 0.75 wt % CCR.

Moreover, instead of a positively charged CCR, the developer base particles obtained by varying the amount of a copolymer resin, which is a negatively charged CCR, including a styrene unit, an acrylic unit, and a quaternary ammonium salt unit (other materials and procedure are the same) are referred to as developer base particles F-1 to F-5, respectively.

In an external addition process after manufacturing the developer base particles, with respect to 100 parts by weight of developer base particles A-1, 2.5 parts by weight of crushed hydrophobic silica R972 (produced by Nippon Aerosil Co., Ltd., average primary particle diameter: 16 nm) (with condensed inorganic particulates separated by a high-speed mixer such as a Henschel mixer), and 2.0 parts by weight of hydrophobic silica RY-50 (produced by Nippon Aerosil Co., Ltd., average primary particle diameter: 90 nm) crushed by the same crushing method as described above are added, and mixed for 2 minutes at a rotation speed of 3200 (rpm) with a 10 liter Henschel mixer. The developer thus obtained is referred to as developer A-1.

Further, developer base particles A-2 to A-5, B-1 to B-5, C-1 to C-5, D-1 to D-5, E-1 to E-5, and F-1 to F-5 with each subjected to the external addition treatment using the same materials and procedures as described above are referred to as developers A-2 to A-5, B-1 to B-5, C-1 to C-5, D-1 to D-5, E-1 to E-5, and F-1 to F-5, respectively. Further, 2.5 parts by weight of hydrophobic silica R972 and 2.0 parts by weight of hydrophobic silica RY-50 represent the central values of the amounts, and the developer base particles are also obtained by using the amount of ±10% parts by weight of each. Here, the average particle diameter of each developer is 5.5 μm.

The volume average particle diameter and the volume ratio of particles of 5 μm or less of the developer are measured using the Coulter Principle. The Coulter Principle is called a pore electrical resistance method (electrical sensing zone method), and a certain current is applied to small pores (apertures) in an electrolyte solution (an aqueous solution or an organic solvent in which electrolytes are dissolved) to measure electric resistance change of the system when the particles pass through the pores. In sum, the Coulter Principle is based on the fact that the particles passing through the pores replace the electrolyte solution corresponding to the particle volume and accordingly the volume of the replaced electrolyte increases the electrical resistance of the pores.

A specific measuring method involves a 30,000 count measurement using the cell count analyzer "Coulter Multisizer 3" (produced by Beckman Coulter, Inc.) with an aperture tube diameter of 100 μm.

1. First, 5 g of Emulgen (produced by Kao Corporation) and 95 g of Isoton (produced by Beckman Coulter, Inc.) are added to a beaker and dissolved with heating while stirred using a stirrer.

2. One microspatula of a toner sample is mixed with 5 ml of a 5% solution of Emulgen and dispersed for 10 seconds with an ultrasonic disperser.

3. 25 ml of Isoton is added to this solution and dispersed for 60 seconds with the ultrasonic disperser to obtain a measurement sample.

4. Measurement cells of Multisizer are filled with the electrolysis solution (Isoton) to confirm that particle numbers are 100 or less in 30 seconds of measurement.

5. The above-described measurement sample is added such that a concentration display is about 10%.

6. After measurement is completed, the volume distribution histogram of the particle is obtained, and the volume average particle diameter and the particle diameter distribution are read from a particle diameter display converted into a sphere equivalent diameter.

Further, the charging characteristics of the obtained developer are measured. The developer is added to the carrier so that the mixing weight ratio of the developer is 5% to obtain a measurement sample. The measurement device is a suction blow type charge amount measurement instrument TB203 (produced by KYOCERA Chemical Corporation). The measurement conditions are a suction pressure of −40 kPa, a blow pressure of 7.0 kPa, and a measurement time of 10 seconds. F-60 (produced by Powdertech Co., Ltd.) is used as a carrier. This carrier (F-60) is in the form of spheres of a Cu—Zn base which has a saturation magnetization of 60 to 70 $Am^2/kg$ and an average particle diameter of 60 μm.

Figure 4:
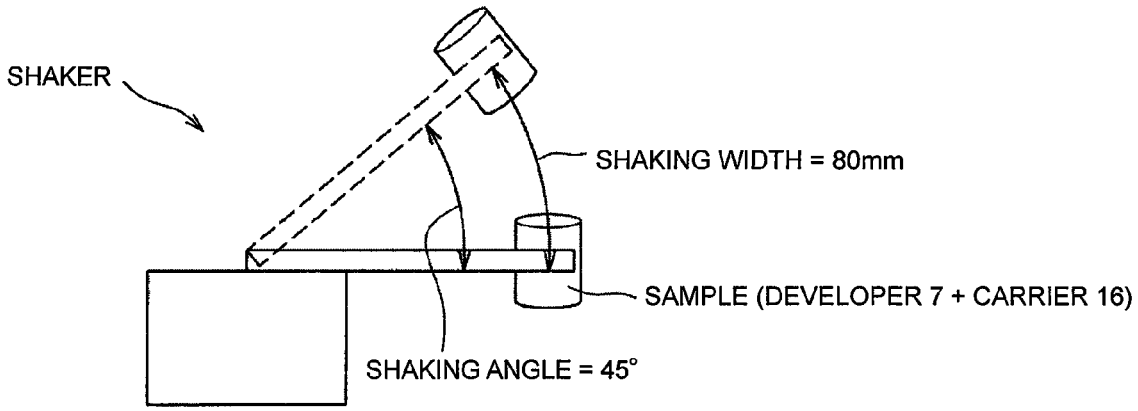
FIG. 4 is a schematic configuration diagram of a shaker configured to evaluate the charge amount of the developer.

FIG. 4 is a schematic configuration diagram of a shaker configured to evaluate the charge amount of the developer.

The measurement sample is charged by stirring developer 7 and the carrier (F-60). The measurement sample is stirred with a shaker Model-YS-LD (produced by YAYOI. Co., Ltd.) at a shaking frequency of 200 times/min, a shaking angle of 45°, a shaking width of 80 mm, and a shaking time of 60 seconds and 600 seconds. Then, the charge amounts of each developer, Q60 (−μC/g) and Q600 (−μC/g), are measured.

The charge amount of the developer is measured, for example, in the following processes using a Q/M-meter (produced by Epping PES Laboratorium).

First, a cell and a cap are placed on a precision balance to perform zero adjustment. About 2.5 g of the developer is put into the cell with a measuring spoon, and then the cell (capped) is placed on the precision balance to read the weight of the developer. After performing zero adjustment of the precision balance again in this state, the cell (capped) is taken out and attached to the body of a measurement instrument. The door of the body is closed and a start button is pressed down (measurement time: 90 seconds, suction quantity: 1,000 $cm^3$/min). After measurement is completed, a VAC digital display value (VAC value) is read. The cell (capped) is taken out and placed on the precision balance to measure the weight (developer suction quantity). The weight is measured twice in succession. When the difference is within ±1.0, the obtained values are averaged to provide a measured value and to calculate a charge amount q of the developer based on the formula: charge amount [μC/g]=(VAC value×10)/(developer suction quantity [mg]). A higher value of charge amount q results in an easier charging of the developer, and a lower value results in a more difficult charging. That is, charge amount q indicates the ease of the developer to be charged. Since the image formation device of the negatively charged electrophotographic system is used in the embodiment, regarding charge amount q, "high" refers to "the absolute value is large in the minus direction" and "low" refers to "the absolute value is small in the minus direction."

The manufacturing conditions and the charging characteristics of each developer are shown in Tables 1 to 6. In the tables, Q600 indicates a "saturation charge amount" of the developer due to sufficient shaking time, and Q60/Q600 indicates "charging properties" of the developer and the value thereof closer to one means better charging properties. The manufacture of the developer with a Q60/Q600 of more than 0.95 is attempted under various conditions but the stable manufacture thereof is failed.

TABLE 1

| Developer Name | CCA (wt %) | CCR (positively charged) (wt %) | Q60 (−μC/g) | Q600 (−μC/g) | Q60/Q600 |
|---|---|---|---|---|---|
| Developer A-1 | 0.10 | 3.00 | 3.8 | 5.1 | 0.75 |
| Developer A-2 | 0.22 | 3.00 | 4.1 | 5.1 | 0.80 |
| Developer A-3 | 0.38 | 3.00 | 4.3 | 5.0 | 0.85 |
| Developer A-4 | 0.60 | 3.00 | 4.4 | 4.9 | 0.90 |
| Developer A-5 | 0.89 | 3.00 | 4.8 | 5.1 | 0.95 |

TABLE 2

| Developer Name | CCA (wt %) | CCR (positively charged) (wt %) | Q60 (−μC/g) | Q600 (−μC/g) | Q60/Q600 |
|---|---|---|---|---|---|
| Developer B-1 | 0.11 | 2.25 | 7.5 | 10.0 | 0.75 |
| Developer B-2 | 0.22 | 2.25 | 7.8 | 9.8 | 0.80 |
| Developer B-3 | 0.38 | 2.25 | 8.4 | 9.9 | 0.85 |
| Developer B-4 | 0.60 | 2.25 | 9.0 | 10.0 | 0.90 |
| Developer B-5 | 0.90 | 2.25 | 9.4 | 9.9 | 0.95 |

TABLE 3

| Developer Name | CCA (wt %) | CCR (positively charged) (wt %) | Q60 (−μC/g) | Q600 (−μC/g) | Q60/Q600 |
|---|---|---|---|---|---|
| Developer C-1 | 0.12 | 1.50 | 11.3 | 15.0 | 0.75 |
| Developer C-2 | 0.23 | 1.50 | 12.0 | 15.0 | 0.80 |
| Developer C-3 | 0.41 | 1.50 | 12.9 | 15.2 | 0.85 |
| Developer C-4 | 0.60 | 1.50 | 13.3 | 14.8 | 0.90 |
| Developer C-5 | 0.91 | 1.50 | 14.2 | 14.9 | 0.95 |

TABLE 4

| Developer Name | CCA (wt %) | CCR (positively charged) (wt %) | Q60 (−μC/g) | Q600 (−μC/g) | Q60/Q600 |
|---|---|---|---|---|---|
| Developer D-1 | 0.13 | 0.75 | 15.0 | 20.0 | 0.75 |
| Developer D-2 | 0.23 | 0.75 | 16.1 | 20.1 | 0.80 |
| Developer D-3 | 0.40 | 0.75 | 17.1 | 20.1 | 0.85 |
| Developer D-4 | 0.60 | 0.75 | 18.2 | 20.2 | 0.90 |
| Developer D-5 | 0.90 | 0.75 | 19.0 | 20.0 | 0.95 |

TABLE 5

| Developer Name | CCA (wt %) | CCR (wt %) | Q60 (−μC/g) | Q600 (−μC/g) | Q60/Q600 |
|---|---|---|---|---|---|
| Developer E-1 | 0.13 | 0.00 | 18.6 | 24.8 | 0.75 |
| Developer E-2 | 0.24 | 0.00 | 19.9 | 24.9 | 0.80 |
| Developer E-3 | 0.41 | 0.00 | 21.3 | 25.0 | 0.85 |
| Developer E-4 | 0.62 | 0.00 | 22.4 | 24.9 | 0.90 |
| Developer E-5 | 0.92 | 0.00 | 23.8 | 25.1 | 0.95 |

TABLE 6

| Developer Name | CCA (wt %) | CCR (negatively charged) (wt %) | Q60 (−μC/g) | Q600 (−μC/g) | Q60/Q600 |
|---|---|---|---|---|---|
| Developer F-1 | 0.13 | 0.75 | 22.4 | 29.8 | 0.75 |
| Developer F-2 | 0.24 | 0.75 | 24.1 | 30.1 | 0.80 |
| Developer F-3 | 0.42 | 0.75 | 25.6 | 30.1 | 0.85 |
| Developer F-4 | 0.63 | 0.75 | 27.0 | 30.0 | 0.90 |
| Developer F-5 | 0.95 | 0.75 | 28.4 | 29.9 | 0.95 |

(Description of Operation)

In FIG. 1, when controller 30 receives a print signal from an external PC (not shown) via a communication interface, controller 30 controls energization of a heater of fixation unit 9 and rotates heat member 9*a* and pressure member 9*b* rotatably accompanied by heat member 9*a*.

When the surface temperature of heat member 9*a* reaches a preset temperature, controller 30 controls energization of a motor and starts feeding a paper. For example, in development device 5, photosensitive drum 1, development roller 2, and developer supply roller 6 rotate in the directions of the arrows shown in FIG. 2. First, developer 7 is supplied to development roller 2 by developer supply roller 6. Next, interaction of development blade 3 with development roller 2 controls the layer thickness of developer 7 and causes the developer to be triboelectrically negatively charged to form the developer layer. Then, the developer layer on the surface of development roller 2 moves and adheres to the latent image on photosensitive drum 1 due to the potential difference (electric field) applied between development roller 2 and photosensitive drum 1, and accordingly the electrostatic latent image is developed. Finally, the target developer image is formed on the surface of medium 10 through transfer by transfer units (transfer belt 12, transfer roller 13).

Medium 10 with the developer image formed thereon is conveyed in the direction of the arrow (h) of FIG. 1 and proceeds to the area between heat member 9*a* and pressure member 9*b*. There, the heat of heat member 9*a* fuses the developer image on medium 10, and pressurization at a pressure weld part between heat member 9*a* and pressure member 9*b* fixes the developer image to medium 10.

The print evaluation described below is performed using each developer manufactured as described above. The image formation device and the development device are the devices described in "Description of Configuration", and the medium is A4 size Excellent White paper (produced by Oki Data Corporation), which is commonly used. Unless otherwise specified, the evaluation conditions other than the developer used are the same.

The printing environment is room temperature 25° C./humidity 40% (hereinafter, referred to as RT environment), the print speed (=linear speed of outermost periphery of the photosensitive drum), i.e. the development speed (=linear speed of the outermost periphery of the development roller), of the device is set to 200 (mm/sec). Then, 10,000 media are printed with a longitudinal direction feed (two short sides of four sides are the front end and the back end) and with a 0.3% duty (where printing of 100% area ratio in solid printing over the entire printable area of one A4 paper is donated as a 100% duty).

In the evaluation, after 10,000 papers are fed and printed, one 0.1% duty pattern is printed and one 25% duty pattern (entire half-tone pattern) are printed, and the obtained print samples are evaluated for sheet fog and blots. The "sheet fog" is a phenomenon that occurs when the developer, having low charge amount and charged in reverse polarity to a regularly charged developer, is attached to a non-exposed area (i.e., an area other than the latent image) in the surface of photosensitive drum 1, and is then transferred to a sheet, thereby damaging the image quality of the printed sheet. Sheet fog is determined by observing predetermined observation parts in the non-exposure zone on the sheet with a 0.1% duty pattern printed thereon.

Figure 5:
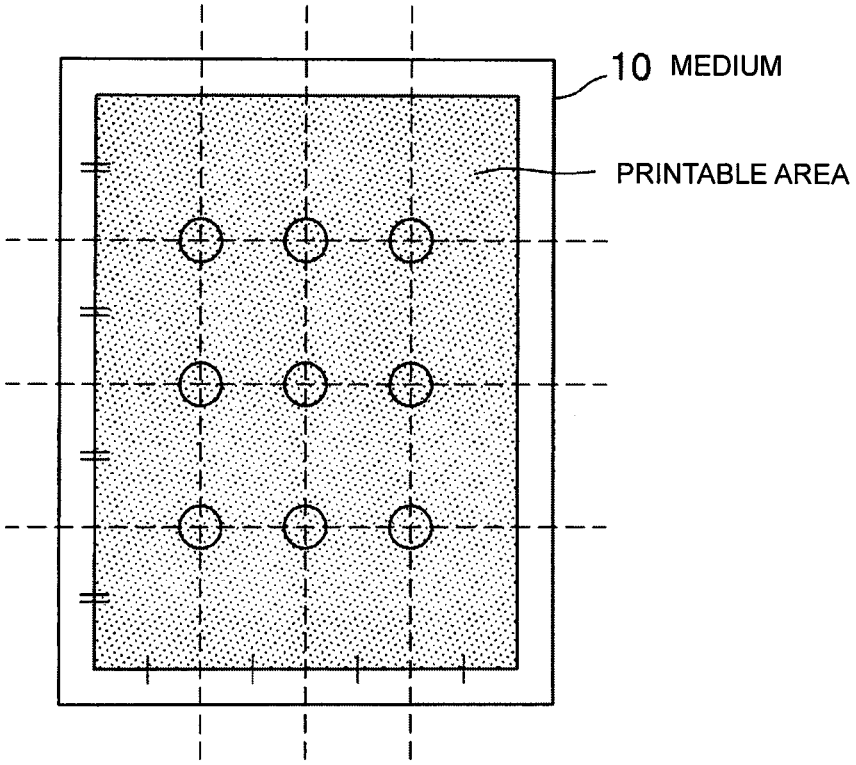
FIG. 5 is a diagram illustrating observation parts of a medium in evaluating the developer by printing.

FIG. 5 is a diagram illustrating the observation parts of the medium in evaluating the developer by printing.

The observation parts are nine points (the parts enclosed by circles on the medium in FIG. 5) at which three straight lines which longitudinally divide a printable area into quarters and three straight lines which laterally divide a printable area into quarters intersect respectively. Digital microscope VHX-100 (produced by KEYENCE CORPORATION) is used for observation. Five points within the observation part are randomly selected, and magnified by 500 times to be observed. The spots of the developer in the field of 0.5 mm×0.5 mm are visually counted to determine the average spot number of the developer at each part. Regarding evaluation criteria, less than 30 of spots of the developer is evaluated as a good image on an actual printed sheet with no visibility of the spots. When 50% or more of the above-described 5 points are evaluated as good, then a "o" is given. The case of less than 50% is given as an "x" for a poor image.

The "blots" mean the phenomenon that the thickness of the developer layer on the surface of development roller 2 partially increases and a developer develops regardless of the presence or absence of the electrostatic latent image on the photosensitive drum, thereby causing a vertical band pattern to be printed. Regarding evaluation criteria, a 25% duty pattern is checked visually, and no blot is given as an "○" for a good image while generation of blots is given as an "x" for a poor image. In addition, generation of blots during printing of 10,000 0.3% duty patterns is also given as an "x".

Figure 6:
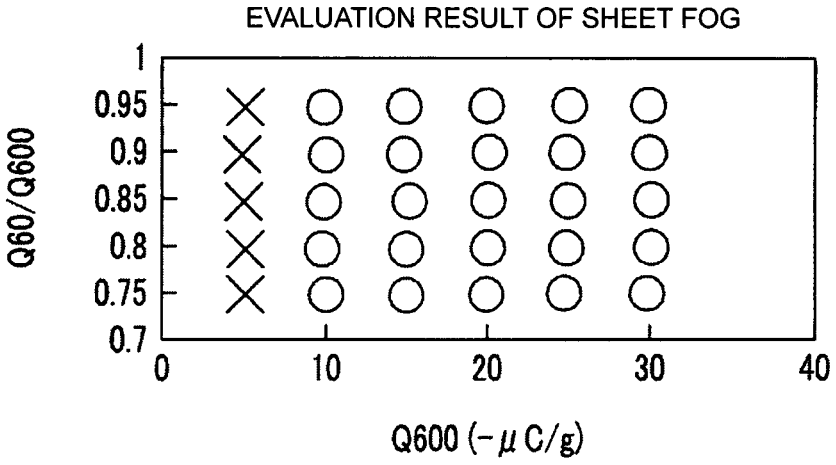
FIG. 6 is a diagram illustrating the evaluation result of sheet fog.
Figure 7:
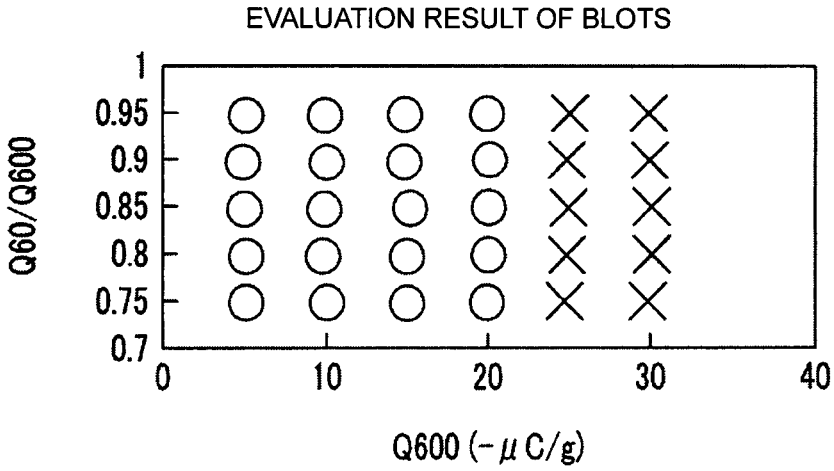
FIG. 7 is a diagram illustrating the evaluation result of blots.

FIG. 6 is a diagram illustrating the evaluation result of sheet fog, and FIG. 7 is a diagram illustrating the evaluation result of blots. Both FIGS. 6 and 7 show the evaluation results of saturation charge amount Q600 and charging properties Q60/Q600 of each developer. When Q600 is less than 10 (−μC/g) (i.e. when the saturation charge amount of the developer is small), the rate of the developer charged in reverse polarity due to a shortage of the charge amount increases, so that the result of sheet fog is poor. Moreover, when Q600 is more than 20 (−μC/g) (i.e. when the saturation charge amount of the developer is large), the thickness of the developer layer on the surface of development roller 2 increases due to electrostatic aggregation caused by an excessive charging, thereby generating blots.

Figure 8:
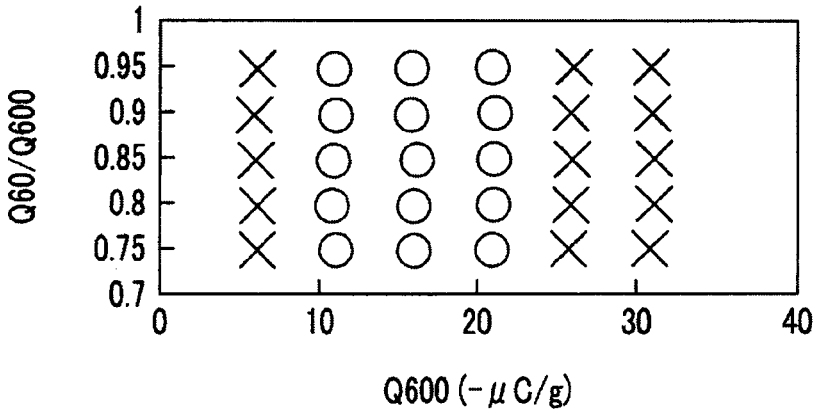
FIG. 8 is a diagram illustrating the evaluation result of sheet fog and blots.

FIG. 8 is a diagram illustrating the evaluation result of sheet fog and blots.

In FIG. 8, in the results of FIGS. 6 and 7, those with both good evaluation results of sheet fog and blots are given as an "○", and those with at least one poor result are given as a "x". FIG. 8 indicates that the images with a good result for sheet fog and no generation of blots are obtained when Q600, i.e., the saturation charge amount of the developer is within the range of 10 to 20 (−μC/g).

Next, only the developers providing the above-described images with a good result for sheet fog and no generation of blots are used to evaluate afterimage as described below. As used here, the "afterimage" means a typing defect of concentration difference generated on typing when a potential difference arises between the portion consumed by printing and the portion not consumed by printing in the developer layer on the surface of development roller 2. A larger concentration difference is more noticeable. Moreover, the afterimage is a phenomenon depending on the potential of the developer layer on the surface of development roller 2, and accordingly it appears in the circular pitch of development roller 2.

Figure 9A:
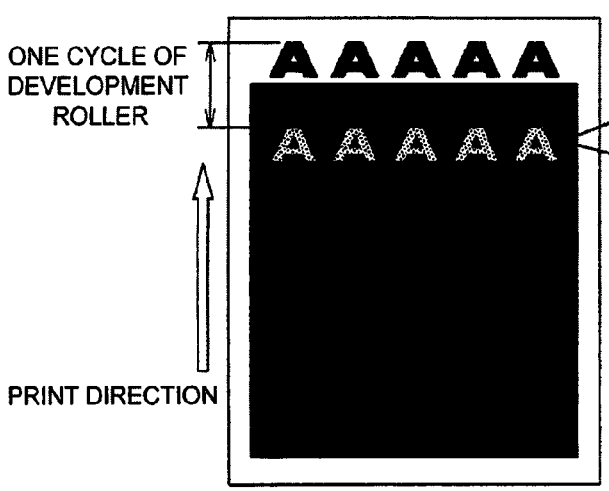
FIGS. 9A and 9B are diagrams illustrating the evaluation pattern of afterimage.
Figure 9B:
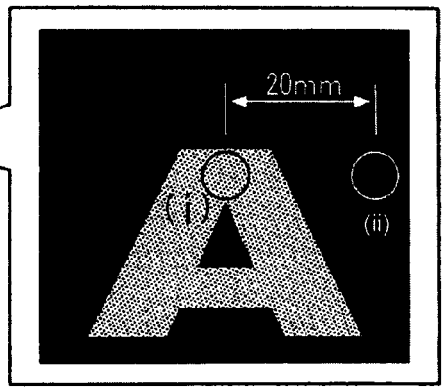

FIGS. 9A and 9B are diagrams illustrating the evaluation pattern of afterimage.

In the evaluation, after 10,000 0.3% duty patterns are printed, the bold solid letters "A" are printed on the head part with respect to a print direction, and the evaluation pattern of a solid image is printed on the subsequent part to the rear end part as shown in FIG. 9A.

In this evaluation pattern, the difference between the concentration of the typed portion ((i) in FIG. 9B) after one cycle of development roller 2, in which the afterimage of the vertex of each bold solid letter "A" is generated, and the image concentration on the portion ((ii) in FIG. 9B) horizontally away from the typed portion by 20 mm to the right is measured by X-Rite528 (produced by X-Rite, Inc.), and the average of five points is calculated. When the average value of the difference of this image concentration is less than 0.20, the degree of the afterimage is low and is rated as an "○" for good. When it is 0.20 or more, the degree of the afterimage is high and rated as a "x" for poor.

Figure 10:
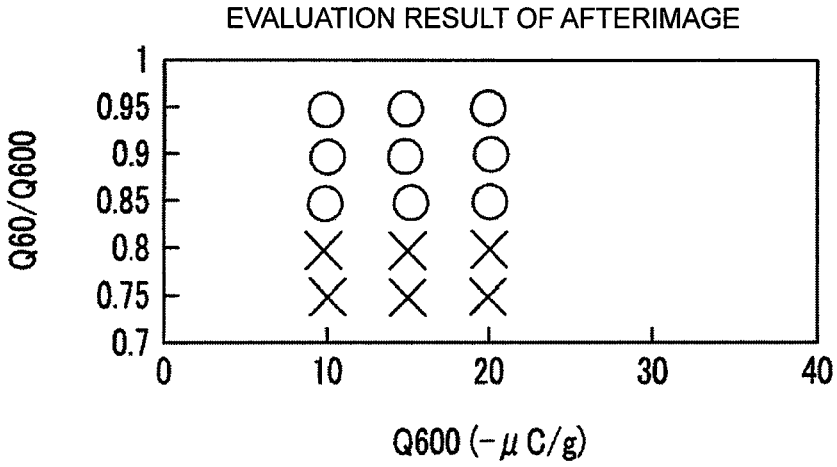
FIG. 10 is a diagram illustrating the evaluation result of afterimage.

FIG. 10 is a diagram illustrating the evaluation result of the afterimage.

In the evaluation result, when Q60/Q600 is 0.85 or more (when charging properties of the developer are high), the afterimage is suppressed and rated as good. This is because sufficiently high charging properties of developer 7 causes the fresh developer newly supplied to the portion consumed by printing to be charged sufficiently in a short period of time on the surface of the development roller and thus reduces the difference of the potential thereof with the developer in the portion which is not consumed by printing.

The evaluation results in FIGS. 8 and 10 show that, at a print speed (linear speed of the outermost periphery of photosensitive drum 1) of 200 (mm/sec), the developer having Q600, i.e., the saturation charge amount, of 10 to 20 (−μC/g) and Q60/Q600 of 0.85 or more provides a good image with few sheet fog and blots generated as well as afterimage suppressed.

Such a successive evaluation is performed by changing only the print speed of the device to 150, 250, 300, and 350 (mm/sec).

The evaluation of print speeds of 250 and 300 (mm/sec) is the same as the result of a print speed of 200 (mm/sec) as described above. However, the evaluation of a print speed of 150 (mm/sec) is rated as poor in the result of sheet fog with all developers. Therefore, subsequent evaluation is stopped. This defect of sheet fog is caused by less frequent triboelectric charging of the developer due to lower print speed. In addition, the evaluation of a print speed of 350 (mm/sec) is rated as poor in the result of blots with all developers. Therefore, subsequent evaluation is stopped. This defect of blots is caused by more frequent triboelectric charging of the developer due to higher print speed.

The above results show that, under the conditions with a print speed (=linear speed of the outermost periphery of the photosensitive drum) of 200 to 300 (mm/sec), the developer having the saturation charge amount of 10 to 20 (−μC/g) and Q60/Q600 of 0.85 or more provides a good image in which sheet fog, blots, and afterimage are suppressed.

The same evaluation as this is also performed under two environments, 10° C./20% (hereinafter, referred as LL environment) and 28° C./80% (hereinafter, referred as HH environment). The evaluation result described here is the result in the case of using the developer of cyan, but the same tendency is also observed in black, yellow, and magenta.

Figure 11:
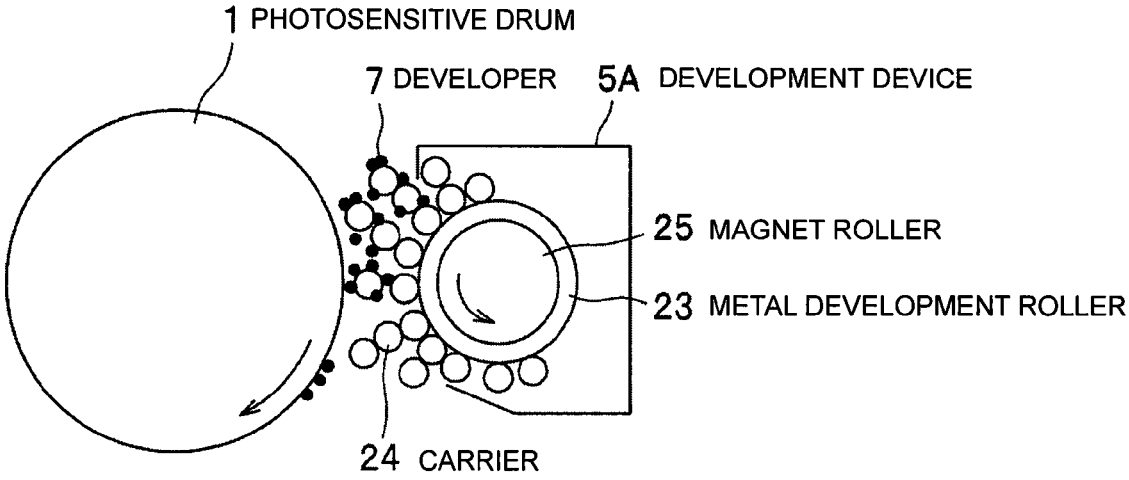
FIG. 11 is a configuration diagram of the development device using a two-component developer.

A one-component developer is described in the embodiment, but the same effect is also observed in a two-component developer. FIG. 11 is a configuration diagram of the development device using the two-component developer.

The development device of FIG. 11 has the configuration in which non-magnetic metal development roller 23 with a certain development bias voltage applied thereto rotates outside magnet roller 25. In this case, a magnetic substance particle (ferrite carrier) having developer 7 electrostatically adhered to the outer surface thereof is used. This carrier 24 is adsorbed to the peripheral surface of metal development rollers 23 along lines of magnetic force in the form of a brush, and brought in contact with photosensitive drum 1 in development. Developer 7 is electrostatically adsorbed to the peripheral surface of photosensitive drum 1, while carrier 24 is attracted to magnet roller 25 and returns to the inside of the development device. Other configurations are the same as those of development device used in the one-component developer, and therefore description is omitted.

(Description of Effects)

Thus, in the case of a print speed (linear speed of the outermost periphery (peripheral speed) of photosensitive drum 1) of 200 to 300 mm/sec, the developer satisfying Q60/Q600 of 0.85 or more and Q600 of 10 to 20 provides good typing even if typing is deteriorated with improvement in print speed. Q60 (−μC/g) represents the charge amount of the developer when the developer is mixed with a carrier (F-60) such that the concentration of the developer is 5% and is shaken for 60 seconds, and Q600 (−μC/g) represents the charge amount of the developer when shaken for 600 seconds under the same conditions.

Second Embodiment (Description of Configuration)

The schematic configuration of an image formation device and the configuration of a development device are the same as those in the first embodiment, and accordingly description is omitted.

All developers manufactured in the first embodiment have externally added 2.5 parts by weight of hydrophobic silica R972 (Nippon Aerosil Co., Ltd., average primary particle diameter: 16 nm) and 2.0 parts by weight of hydrophobic silica RY-50 (Nippon Aerosil Co., Ltd., average primary particle diameter: 40 nm) with respect to 100 parts by weight of a developer base particles (this external addition condition is named as "external addition 1"). In a second embodiment, the amount of hydrophobic silica R972 added is changed from 2.5 wt % to 6.0 wt %, and the amount of hydrophobic silica RY-50 added is changed from 2.0 wt % to 0.0 wt % to carry out external addition so that the developer has a predetermined fluidity. Specific external addition conditions are shown in Table 7.

TABLE 7

| Name of External Addition Condition | Amount of R972 Added (wt %) | Amount of RY-50 Added (wt %) |
|---|---|---|
| External Addition 1 | 2.5 | 2.0 |
| External Addition 2-1 | 3.0 | 1.7 |
| External Addition 2-2 | 3.5 | 1.4 |
| External Addition 2-3 | 4.0 | 1.1 |
| External Addition 2-4 | 4.5 | 0.8 |
| External Addition 2-5 | 5.0 | 0.5 |
| External Addition 2-6 | 5.5 | 0.2 |
| External Addition 2-7 | 6.0 | 0.0 |

As described in the first embodiment, developer base particles (developer base particles B-3 to B-5, C-3 to C-5, D-3 to D-5) providing good printing image with a low degree of sheet fog, blots, and afterimage under the condition of a print speed of 200 to 300 (mm/sec) are used as developer base particles. These developer base particles are subjected to external additions under the conditions of external additions 2-1 to 2-7 to manufacture new developers, respectively. The developer manufactured by subjecting developer base particles B-3 to the external addition under the condition of external addition 2-1 is referred to as developer B-3 (2-1). Similarly, the developer manufactured by subjecting developer base particles B-3 to the external addition under the condition of external addition 2-2 is referred to as developer B-3 (2-2). The subsequent developers to developer D-5 (2-7) are named in the same way.

Figure 12:
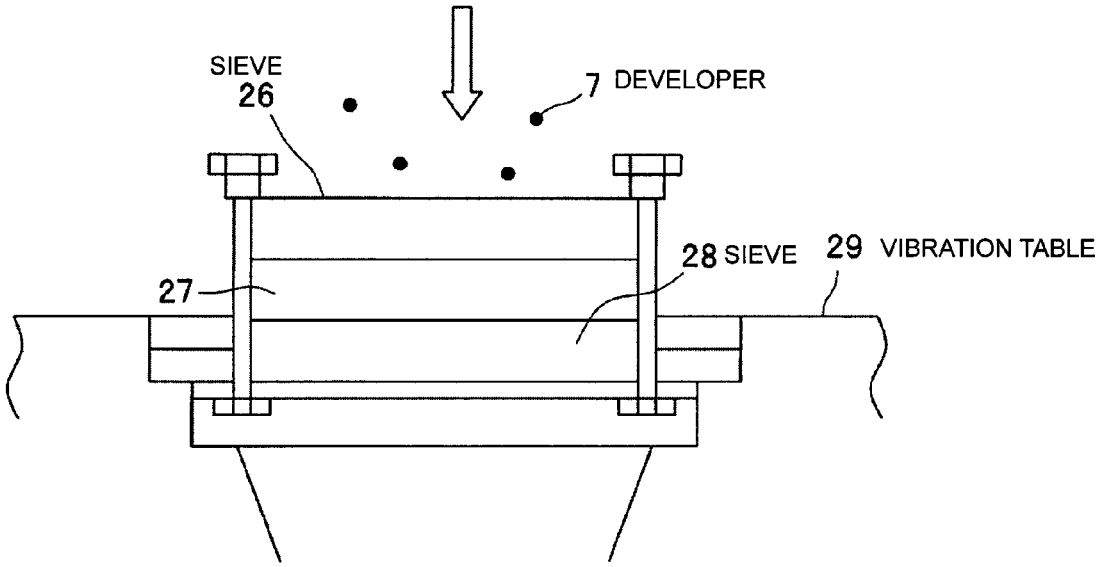
FIG. 12 is a diagram illustrating a method for measuring the fluidity of the developer.

FIG. 12 is a diagram illustrating the method for measuring the fluidity of the developer.

Next, the fluidity is measured by the following method for the developers manufactured in the first embodiment and the developers newly obtained in this embodiment. Powder Tester PT-S (Hosokawa Micron Ltd.) is used for the measurement device. Sieve 26 with openings of 150 μm, sieve 27 with openings of 75 μm, and sieve 28 with openings of 45 μm are stacked on vibration table 29 of the Powder Tester. Then, 2.0 g of the developer is softly placed on sieve 26 with openings of 150 μm, followed by vibration at an amplitude of 0.8 mm for 95 seconds. Subsequently, the weight of the developer on each sieve is measured and the fluidity (adhesion coherence) is calculated by the following formula.

(The weight of the developer on the sieve with openings of 150 μm/2.0)×100+(the weight of the developer on the sieve with openings of 75 μm/2.0)×(3/5)×100+(the weight of the developer on the sieve with openings of 45 μm/2.0)×(1/5)×100=A, Fluidity (%)=100−A. This is repeated 10 times with the same developer and the average value is taken as the fluidity of the developer. The results of measurement of fluidity are shown in Tables 8 and 9.

TABLE 8

| Name of Developer Base particles | Name of External Addition Condition | | | |
|---|---|---|---|---|
| | External Addition 1 | External Addition 2-1 | External Addition 2-2 | External Addition 2-3 |
| Developer B-3 | 59.8 | 65.0 | 70.2 | 74.9 |
| Developer B-4 | 59.9 | 65.2 | 70.2 | 74.9 |
| Developer B-5 | 60.2 | 65.1 | 69.9 | 75.0 |
| Developer C-3 | 60.0 | 65.1 | 69.8 | 75.1 |
| Developer C-4 | 60.0 | 65.1 | 70.1 | 75.1 |
| Developer C-5 | 59.8 | 64.9 | 69.9 | 74.8 |
| Developer D-3 | 60.1 | 64.9 | 70.2 | 74.9 |
| Developer D-4 | 59.8 | 64.8 | 69.9 | 75.1 |
| Developer D-5 | 59.9 | 65.0 | 70.0 | 74.8 |

TABLE 9

| Name of Developer Base particles | Name of External Addition Condition | | | |
|---|---|---|---|---|
| | External Addition 2-4 | External Addition 2-5 | External Addition 2-6 | External Addition 2-7 |
| Developer B-3 | 79.9 | 85.0 | 89.9 | 94.8 |
| Developer B-4 | 79.9 | 84.9 | 90.0 | 94.8 |
| Developer B-5 | 79.7 | 85.1 | 89.8 | 94.9 |
| Developer C-3 | 80.0 | 84.8 | 90.1 | 94.7 |
| Developer C-4 | 79.9 | 85.0 | 90.1 | 94.8 |
| Developer C-5 | 79.8 | 84.9 | 89.8 | 94.6 |
| Developer D-3 | 80.0 | 84.8 | 90.0 | 94.8 |
| Developer D-4 | 80.0 | 85.0 | 89.9 | 94.7 |

TABLE 9-continued

| Name of Developer Base particles | Name of External Addition Condition | | | |
|---|---|---|---|---|
| | External Addition 2-4 | External Addition 2-5 | External Addition 2-6 | External Addition 2-7 |
| Developer D-5 | 79.8 | 84.9 | 89.8 | 94.9 |

As a result of measurement, the same external addition condition provides almost the same fluidity regardless of the developer base particles used. The manufacture of the developer having the fluidity of more than 95 is attempted under various conditions but the stable manufacture thereof is failed. Further, the charging characteristics (Q60 and Q600) of the developer newly manufactured under the same conditions as the first embodiment are also measured. In this case, the same developer base particles provide the same Q60 and Q60/Q600 regardless of the external addition condition applied.

(Description of Operation)

Operation of an image formation device and a development device is the same as that in the first embodiment, and accordingly description is omitted. The developers manufactured in the second embodiment and the developers B-3 to B-5, C-3 to C-5, and D-3 to D-5 manufactured in the first embodiment as comparative examples are used for the following evaluation. The conditions which are not specified are considered as the same as those in the first embodiment.

First, eight kinds of developers B-3, B-3 (2-1) to B-3 (2-7) with the same developer base particles but different fluidity (and external addition condition) are used to evaluate sheet fog and blots with the method of the first embodiment under six conditions of print speed of the device: 150, 200, 250, 300, 350, and 400 (mm/sec).

The results of sheet fog are rated as "○" (good) in all combinations.

Figure 13:
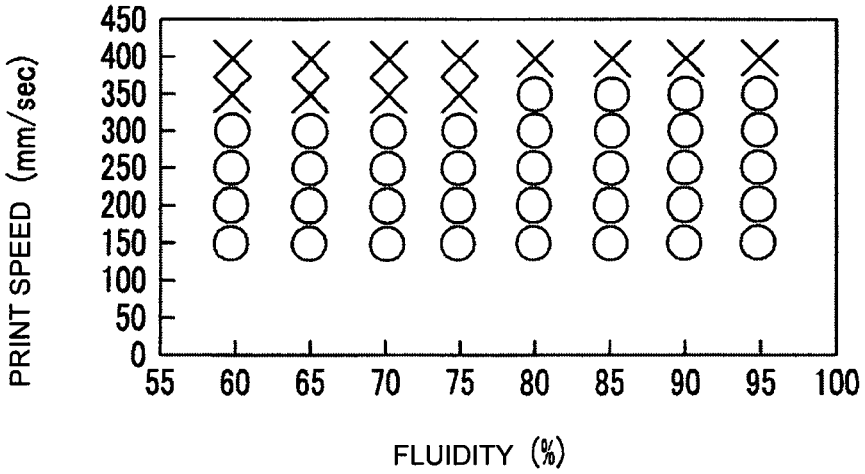
FIG. 13 is a diagram illustrating the evaluation result of blots of developer base particle B-3 series.

FIG. 13 is a diagram illustrating the evaluation result of blots of developer base particles B-3 series.

FIG. 13 shows that blots are generated in a higher speed area than a print speed (development speed) of 300 (mm/sec) when the fluidity is less than 80(%), and blots are not generated up to a print speed of 350 (mm/sec) when the fluidity is 80(%) or more. This may be because increased fluidity of the developer suppresses electrostatic aggregation of the developer, which is one of the causes of blot generation.

This evaluation is carried out for other developers in the same way by changing only the developer. The evaluation results are the same as those of developers B-3, B-3 (2-1) to B-3 (2-7). Sheet fog is "○ (good)" in all the combinations. Blots are generated in a higher speed area than a print speed (development speed) of 300 (mm/sec) when the fluidity is less than 80(%), and blots are not generated up to a print speed of 350 (mm/sec) when the fluidity is 80(%) or more. With respect to the second embodiment, the same evaluation is carried out for two environments, LL environment and HH environment, and with developers (black, yellow, magenta) other than cyan which is used in the evaluation result as described here, as well as the two-component developer. As a result, the same tendency is observed.

(Description of Effects)

Accordingly, when the fluidity of the developer is 80% or more, good typing with no generation of blots even in a higher speed area can be obtained. As shown in Table 7, external additions 2-5, 2-6, 2-7 are used for the developer to have the fluidity of 80%, which is any of that with external addition of 5 parts by weight of hydrophobic silica R972 and 0.5 parts by weight of hydrophobic silica RY-50, that with external addition of 5.5 parts by weight of hydrophobic silica R972 and 0.2 parts by weight of hydrophobic silica RY-50, and that with external addition of 6 parts by weight of hydrophobic silica R972, with respect to 100 parts by weight of the developer base particles.

(Modification)

The invention is not limited to the above-described embodiments and the following various modifications are possible, for example. (1) According to each of the above-described embodiments, LED head 4 is used as an exposure device, but the way in which a laser oscillator and a polygon mirror are used to reflect a laser beam with the polygon mirror to form an electrostatic latent image on a photoreceptor also can be employed. (2) According to the above-described embodiments, development roller 2 and developer supply roller 6 are provided in development device 5 assuming that toner cartridge 22 is detachable from development device 5, but development roller 2 and developer supply roller 6 can be provided in a toner cartridge to be integrated.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer cartridge containing developer suitable to develop an electrostatic latent image when the developer is dispensed from the cartridge to a development carrier of a development device, the developer satisfying the requirements of $0.85 \leq Q60/Q600$ and $10 \leq Q600 \leq 20$, where Q60 (−μC/g) represents a charge amount of the developer when a sample made by adding the developer to a carrier in the form of spheres of a Cu—Zn base which has a saturation magnetization of 60 to 70 $Am^2/kg$ such that the concentration of the developer is 5% by weight is shaken for 60 seconds, and Q600 (−μC/g) represents a charge amount of the developer when shaken for 600 seconds under the same conditions; wherein the developer comprises a developer base particle and hydrophobic silica as external additive particles attached to the surface of the developer base particle, the developer base particle comprises 100 plus or minus 10% parts by weight of an amorphous polyester resin, 0.41 to 0.91 parts by weight of a metal complex of salicylic acid, 0.75 to 2.25 parts by weight of a polyester resin having a quaternary ammonium salt, and the developer fluidity is 80% or more, wherein the fluidity is the average value of $G=(X/2+3Y/10+Z/10)\times 100$, where X represents the weight of the developer on a sieve with openings of 150 μm, Y represents the weight of the developer on a sieve with openings of 75 μm, and Z represents the weight of the developer on a sieve with openings of 45 μm, when the three sieves each with openings of 45 μm, 75 μm, 150 μm are stacked in this order, and 2 g of the developer is placed on the sieve with openings of 150 μm as a top sieve, followed by vibration at an amplitude of 0.8 mm for 95 seconds.

2. The developer cartridge according to claim 1, wherein the carrier has an average particle diameter of 60 μm.

3. The developer cartridge according to claim 1, wherein the developer base particle further comprises 4.0±10% parts by weight of a colorant, and 3.0±10% parts by weight of a release agent.

4. The developer cartridge according to claim 1, wherein the external additive particles comprise 5 parts by weight of hydrophobic silica having an average primary particle diameter of 16 nm and 0.5 parts by weight of hydrophobic silica having an average primary particle diameter of 40 nm with respect to 100 parts by weight of the developer base particle.

5. The developer cartridge according to claim 1, wherein the external additive particles comprise 5.5 parts by weight of hydrophobic silica having an average primary particle diameter of 16 nm and 0.2 parts by weight of hydrophobic silica having an average primary particle diameter of 40 nm with respect to 100 parts by weight of the developer base particle.

6. The developer cartridge according to claim 1, wherein the external additive particles comprise 6 parts by weight of hydrophobic silica having an average primary particle diameter of 16 nm with respect to 100 parts by weight of the developer base particle.

7. The developer cartridge according to claim 1, wherein the developer is shaken at a shaking width of 80 mm and a shaking angle of 45°.

* * * * *